US010041332B2

(12) United States Patent
Roane et al.

(10) Patent No.: US 10,041,332 B2
(45) Date of Patent: Aug. 7, 2018

(54) DUAL ISOLATION WELL ASSEMBLY

(71) Applicant: Halliburton Energy Services, Inc., Houston, TX (US)

(72) Inventors: Thomas Roane, Alvord, TX (US); Antonio Rosas, Mesquite, TX (US); Zheng Guan, Carrollton, TX (US); Thomas Edward Hubert, Paris (FR)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 14/430,695

(22) PCT Filed: Jan. 13, 2014

(86) PCT No.: PCT/US2014/011323
§ 371 (c)(1),
(2) Date: Mar. 24, 2015

(87) PCT Pub. No.: WO2015/105517
PCT Pub. Date: Jul. 16, 2015

(65) Prior Publication Data

US 2016/0032685 A1 Feb. 4, 2016

(51) Int. Cl.

| | |
|---|---|
| ***E21B 34/14*** | (2006.01) |
| ***E21B 21/10*** | (2006.01) |
| *E21B 34/00* | (2006.01) |

(52) U.S. Cl.
CPC ..... *E21B 34/14* (2013.01); *E21B 21/10* (2013.01); *E21B 2034/007* (2013.01)

(58) Field of Classification Search
CPC .... E21B 21/10; E21B 34/14; E21B 2034/007; E21B 43/04; E21B 43/02; E21B 43/05; E21B 23/002
See application file for complete search history.

(56) References Cited

U.S. PATENT DOCUMENTS

| | | | | |
|---|---|---|---|---|
| 4,428,428 | A | 1/1984 | Smyrl et al. | |
| 4,440,218 | A * | 4/1984 | Farley | E21B 23/006 166/133 |
| 5,332,038 | A | 7/1994 | Tapp et al. | |
| 5,343,949 | A * | 9/1994 | Ross | E21B 17/07 166/278 |

(Continued)

FOREIGN PATENT DOCUMENTS

| | | |
|---|---|---|
| EP | 0757156 | 2/1997 |

OTHER PUBLICATIONS

Authorized Officer Jong Kyung Lee, PCT International Search Report and Written Opinion of the International Searching Authority, PCT/US2014/011323, dated Oct. 23, 2014, 12 pages.

*Primary Examiner* — Waseem Moorad
*Assistant Examiner* — Neel Girish Patel
(74) *Attorney, Agent, or Firm* — Scott Richardson; Parker Justiss, P.C.

(57) ABSTRACT

A working string is used to actuate a first valve of a completion string in a well to seal a float shoe of the completion string from a remainder of the completion string. The working string is also used to actuate a second valve of the completion string to seal the center bore of the completion string. Actuating the first valve and the second valve is performed without withdrawing the working string from the well. In certain instances, the working string is a washpipe that includes a shifting profile for each valve.

13 Claims, 7 Drawing Sheets

(56) References Cited

U.S. PATENT DOCUMENTS

| | | | | |
|---|---|---|---|---|
| 5,413,180 | A * | 5/1995 | Ross | E21B 23/06 166/194 |
| 6,378,609 | B1 | 4/2002 | Oneal et al. | |
| 6,513,599 | B1 | 2/2003 | Bixenman et al. | |
| 8,082,993 | B2 * | 12/2011 | Craig | E21B 34/14 166/278 |
| 8,347,968 | B2 | 1/2013 | Debard et al. | |
| 8,813,850 | B2 * | 8/2014 | Geoffroy | E21B 43/04 166/278 |
| 2004/0084182 | A1 | 5/2004 | Edgar et al. | |
| 2005/0236153 | A1 | 10/2005 | Fouras et al. | |
| 2006/0231253 | A1 * | 10/2006 | Vilela | E21B 37/08 166/278 |
| 2010/0108323 | A1 | 5/2010 | Wilkin | |
| 2012/0080190 | A1 * | 4/2012 | Rytlewski | E21B 43/26 166/281 |
| 2013/0008652 | A1 * | 1/2013 | Broussard | E21B 33/124 166/278 |
| 2015/0218916 | A1 * | 8/2015 | Richards | E21B 34/14 166/278 |
| 2016/0032685 | A1 * | 2/2016 | Roane | E21B 21/10 166/373 |

* cited by examiner

DUAL ISOLATION WELL ASSEMBLY

This application is a 371 U.S. National Phase Application of and claims the benefit of priority to International Application Serial No. PCT/US2014/011323, filed on Jan. 13, 2014 and entitled "Dual Isolation Well Assembly", the contents of which are hereby incorporated by reference.

BACKGROUND

The present disclosure relates to completing well systems.

In certain well completions, the completion string includes a float shoe at its lower, downhole end that operates as a check valve, allowing fluids to flow out of the completion string, but not allowing fluids to flow into the completion string. The float shoe enables circulation of fluids into the wellbore, such as with washdown and other fluid displacement operations. In a washdown operation, a working string, called a washpipe, is run into the completion string and completion fluids are pumped down through the working string and up through the annulus to displace debris and drilling fluids in the wellbore. Typically, once the washdown is complete, the ability to flow fluids out of the float shoe is not needed. Therefore, a valve, commonly operated with a shifting tool, can be provided above the float shoe to isolate the float shoe from the remainder of the completion string. The closed valve serves as a secondary shutoff of the float shoe, and particularly in an injection well, prevents the float shoe from opening again.

Prior to putting the well on production or injection, the completion string is pressure tested. Also, in some instances there is a need to seal a portion of the completion string from producing fluids to the surface. A reservoir isolation valve is provided in the completion string to seal the producing portions of the completion string from the remaining portions. Some reservoir isolation valves close on withdrawal of the washpipe, and can be reopened in response to a remote pressure signal and/or with a shifting tool.

DESCRIPTION OF DRAWINGS

FIG. 5A is continued to FIG. 5B, which is continued to FIG. 5C, which is continued to FIG. 5D.

FIG. 6A is continued to FIG. 6B, which is continued to FIG. 6C, which is continued to FIG. 6D.

FIG. 7A is continued to FIG. 7B, which is continued to FIG. 7C, which is continued to FIG. 7D.

Like reference symbols in the various drawings indicate like elements.

DETAILED DESCRIPTION

The concepts herein encompass a manner of completing a well that enables actuating a valve to seal the float shoe from a remainder of the completion string and actuating another valve to seal the completion string, for example to isolate the producing zones, with the same working string and without withdrawing the working string from the well. Thus, a valve isolating the float shoe against potential leakage and from opening by injection flow and a valve, such as a reservoir isolation valve, can both be actuated without having to make multiple trips into the well. The working string can be a washpipe, enabling a washdown operation to be performed in the same trip as both valves are actuated. Further, in certain instances, the working string can be used to operate the valves open and closed multiple times, again without withdrawing the working string from the wellbore.

Figure 1:
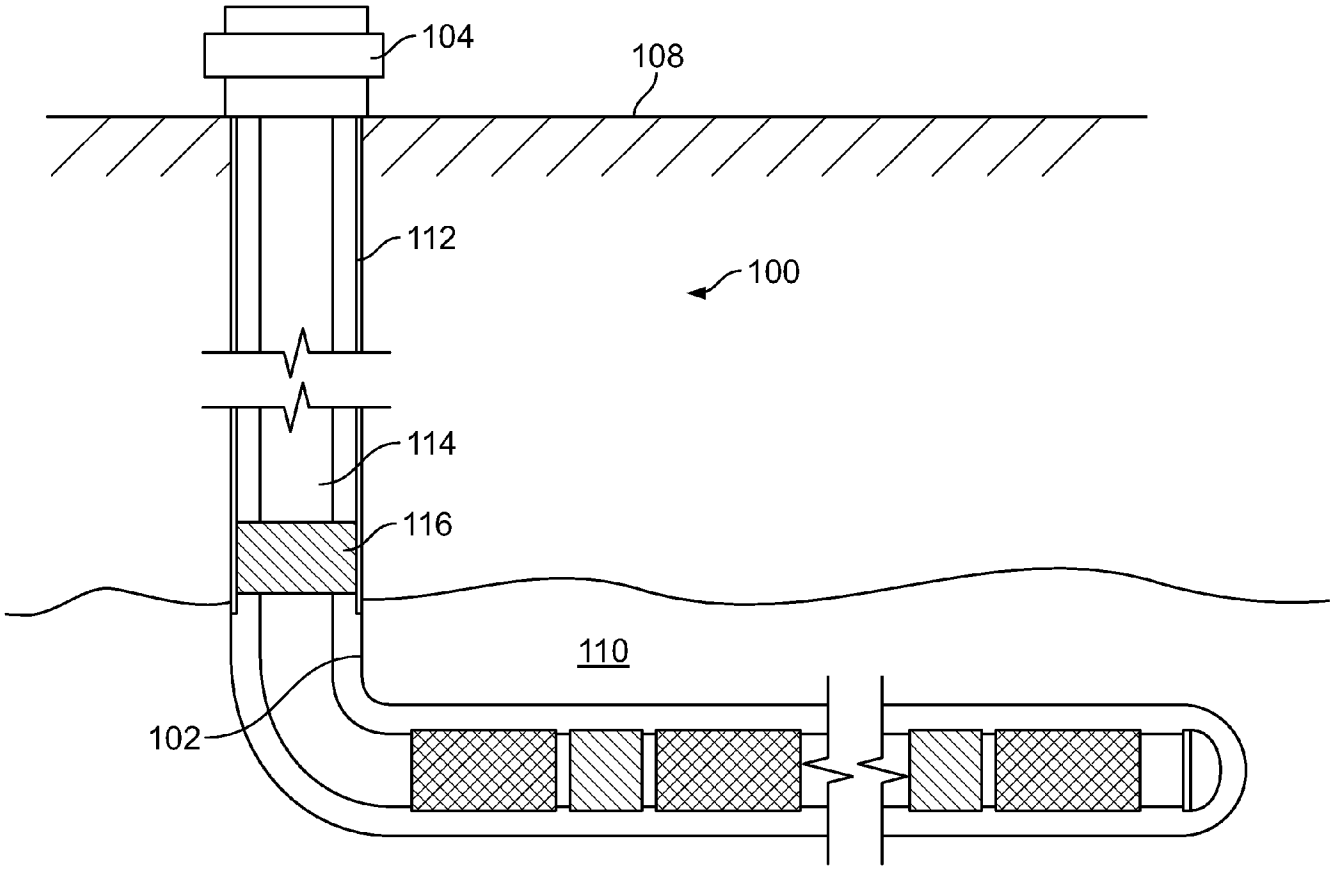
FIG. 1 is a partial side cross-sectional view of an example well system incorporating the concepts herein.

FIG. 1 is a side cross-sectional view of a well system 100. As shown, the well system 100 includes a substantially cylindrical wellbore 102 that extends from a wellhead 104 at a terranean surface 108 into one or more subterranean zones of interest 110 (one shown). In FIG. 1, the wellbore 102 extends substantially vertically from the surface 108 and deviates to horizontal in the subterranean zone 110. However, in other instances, the wellbore 102 can be different. For example, the wellbore 102 can be entirely substantially vertical or slanted, it can deviate in another manner than horizontal, it can be a multi-lateral, and/or it can be of another configuration. Likewise, although shown as a land-based well system 100 in FIG. 1, in other instances, the well system 100 can be a subsea or offshore well.

The wellbore 102 is lined with a casing 112, constructed of one or more lengths of tubing, that extend from the wellhead 104 downhole toward the bottom of the wellbore 102. The casing 112 provides radial support to the wellbore 102 and seals against unwanted communication of fluids between the wellbore 102 and the surrounding formations. Here, the casing 112 ceases at the subterranean zone 110 and the remainder of the wellbore 102 is open hole, i.e., uncased. In other instances, the casing 112 can extend to the bottom of the wellbore 102 or can be provided in another configuration.

A completion string 114 of tubing and other components is coupled to the wellhead 104 at the surface 108 and extends through the wellbore 102, downhole, into the subterranean zone 110. The completion string 114 is used, once the well system 100 is brought onto production, to produce fluids from and/or inject fluids into the subterranean zone 110. Prior to bringing the well system 110 onto production, the completion string 114 is used to perform the final steps in constructing the well, including a washdown operation. The completion string 114 is shown with a packer 116 above the subterranean zone 110 that seals the annulus between the completion string 114 and the casing 112, and directs fluids to flow through the completion string 114 to the surface 108 rather than through the annulus.

In certain instances, the completion string 114 is provided into the wellbore 102 in a single trip. In certain instances, and more commonly, the completion string 114 is placed in multiple parts, for example, as lower completion string and an upper completion.

Figure 2A:
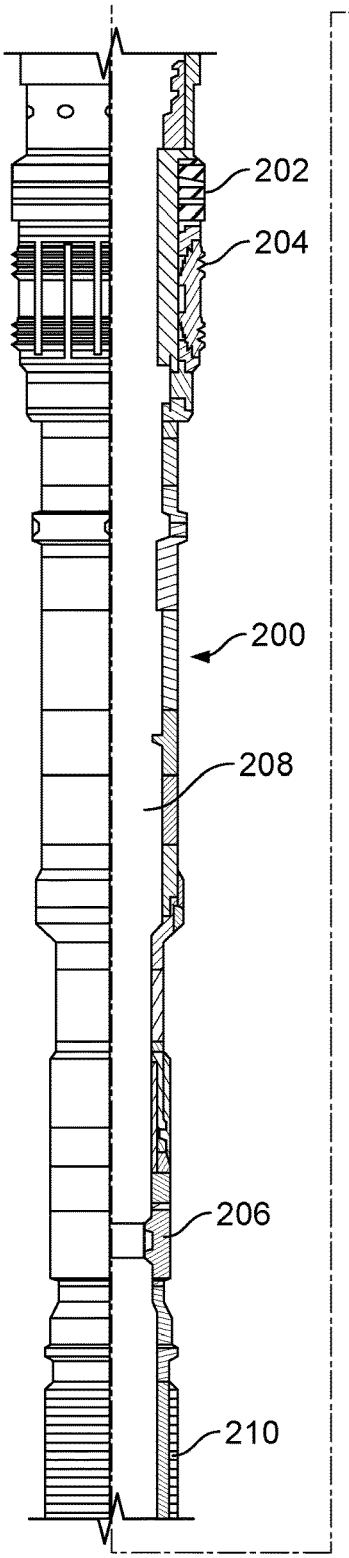
FIGS. 2A and 2B are a partial side cross-sectional view of an example lower completion string.
Figure 2B:
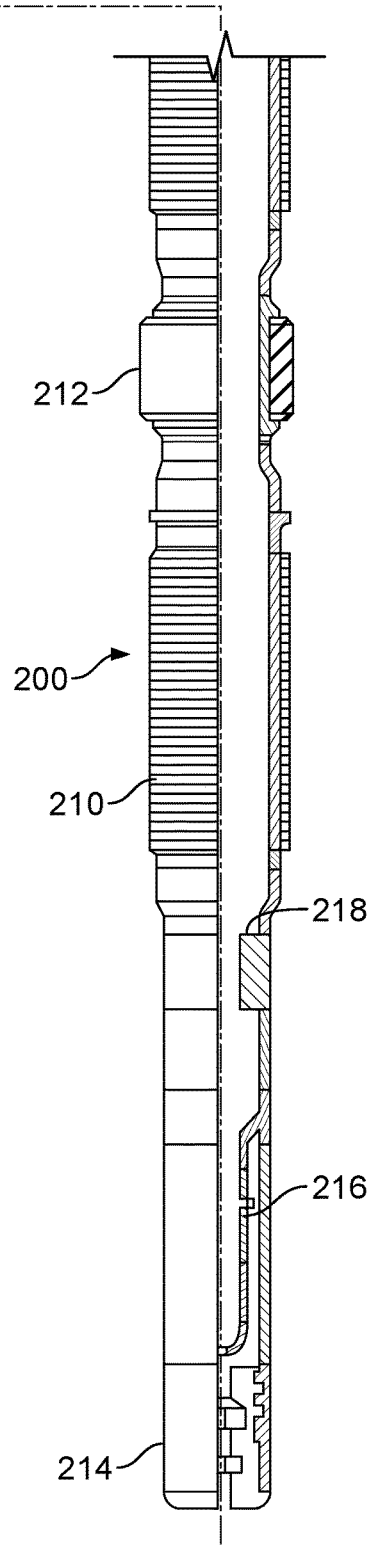

FIG. 2 is a partial side cross-sectional view of an example lower completion string 200. Typically, the lower completion string is run into the wellbore and into position first, a valve near the uphole end of the lower completion closed to prevent flow of fluids through the lower completion string, and then, the upper completion string is run into the wellbore and landed in the lower completion string. The result is a completion string that extends from the bottom of the well to the wellhead at the surface.

The lower completion string can take many different forms; therefore, the lower completion string 200 of FIG. 2 is shown for convenience of discussion purposes only. The lower completion string 200 includes a packer 202 near its uphole end. The packer 202 is actuable to seal between the lower completion string 200 and the casing to prevent flow of fluid through the annulus between the lower completion string 200 and the casing. The uphole end of the lower completion string 200 additionally includes slips 204 actuable to grip the inner wall of the casing to support the lower completion string 200 in the wellbore. A reservoir isolation valve 206 is provided in the lower completion string 200 below the packer 202. Below the reservoir isolation valve 206, the lower completion string 200 is provided with one or more joints that allow passage of fluids between (in and out of) the center bore 208 of the lower completion string 200 and the well bore, and thus, subterranean zone. Here these joints are shown as sand screens 210 that filter against particulates of a specified size or larger into the center bore 208 of the lower completion string 200. A swell packer 212 is provided between some of the sand screens 210 to seal the annulus between sand screens 210 and define production or injection intervals. Although shown as only two sand screens 210 with a swell packer 212 between them, in most instances, there will be many sand screens 210 and many swell packers 212, extending the length of the open hole section of the wellbore.

The downhole end of the lower completion string 200 includes a float shoe 214. The float shoe 214 has one or more internal check valves biased to allow flow from a center bore 208 of the lower completion string 200 into the wellbore and seal against flow from the wellbore into the center bore 208 of the lower completion string 200. Thus, as the lower completion string 200 is being run into the wellbore, the float shoe 214 seals against ingress of fluids into the lower completion string 200. With the lower completion string 200 in place, the float shoe 214 allows flowing completion fluids from a working string inside the center bore 208 of the lower completion string 200 into the wellbore.

The lower completion string 200 includes a valve 216 in its center bore 208, uphole from the float shoe 214. The valve 216 is changeable between an open state, where it allows flow of fluids between the center bore 208 of the remainder of the lower completion string 200 and the float shoe 214, and a closed state, where the seals against flow fluids between the center bore 208 of the remainder of the lower completion string 200 and the float shoe 214. Therefore in completing the well, fluids can be pumped through the lower completion string 200 (via a working string) into the wellbore through the valve in the open state and the float shoe 214. Thereafter, the valve 216 can be closed to isolate (i.e. seal) the float shoe 214 from the remainder of the center bore 208 of the lower completion string 200. If the float shoe 214 subsequently leaks, for example while the well is being produced, its leakage will not be communicated into the fluids being produced up the center bore 208.

Figure 3A:
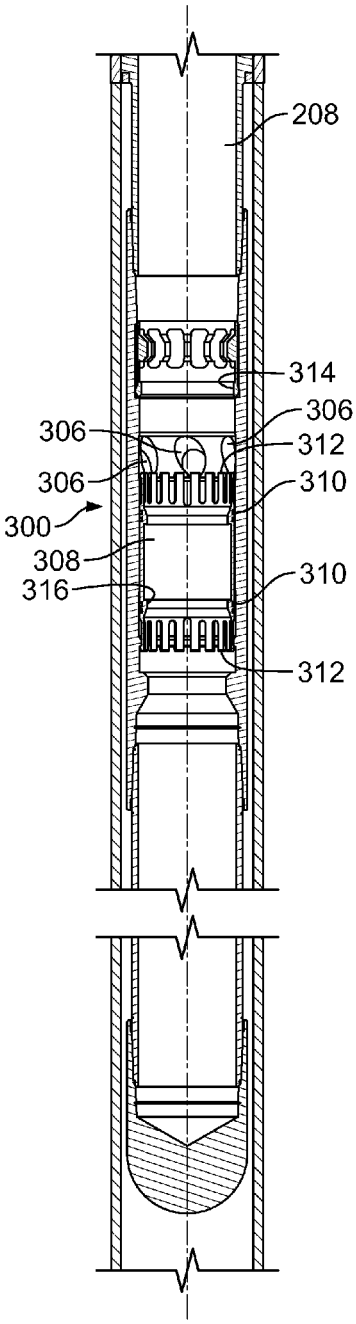
FIGS. 3A and 3B are a half cross-sectional detail view of an example sliding sleeve valve in a completion string.
Figure 3B:
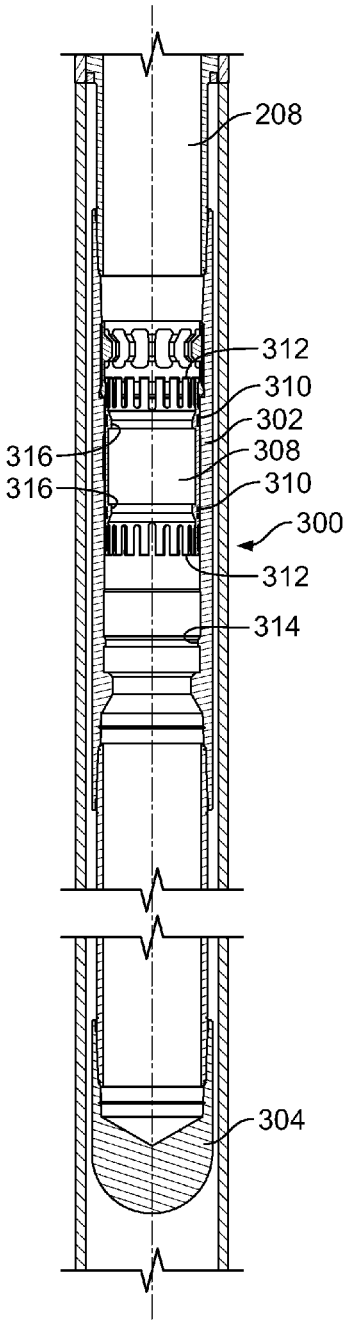

The valve 216 to isolate the float shoe 214 from the remainder of the lower completion string 200 can take many forms. In certain instances, the valve 216 is a sliding sleeve valve. FIGS. 3A and 3B show an example sliding sleeve valve 300 that can be used. The sliding sleeve valve 300 has a main tubing 302 that sealingly couples to the remainder of the lower completion string 200. At its uphole end, the center bore of the main tubing 302 coincides with the center bore of the remainder of the lower completion string 200 above the sliding sleeve valve 300. At its downhole end, the main tubing 302 is sealed from the interior of the central bore 208 and from the float shoe 214 by a cap 304. The main tubing 302 includes one or more ports 306 (a plurality shown), and internally receives a sliding sleeve 308 that is movable between covering the ports 306 and not covering the ports 306. The sliding sleeve 308 has seals 310 near its upper and lower ends, such that when the seals 310 straddle the ports 306 the sliding sleeve 308 seals against fluid flow through the ports 306. The upper and lower ends of the sliding sleeve 308 include a latch. In certain instances, the latch is one or more (a plurality shown) radially outwardly biased collet fingers 312. The inner wall of the main tubing 302 includes spaced apart collet finger grip profiles 314. One collet finger grip profile 314 is positioned so that the collet fingers 312 on the upper end of the sliding sleeve 308 grip the profile 314 and hold the sliding sleeve 308 covering the ports 306. The other collet finger grip profile 314 is positioned so that the collet fingers 312 on the lower end of the sliding sleeve 308 grip the profile 314 and hold the sliding sleeve 308 apart from the ports 306. The interior of the sliding sleeve 308 additionally has a profile 316 to allow the sliding sleeve 308 to be gripped by a shifting tool (discussed in more detail below). Therefore, in operation, when it is desired for fluids to flow from the center bore 208 above the sliding sleeve valve 300 out the float shoe 214, the sliding sleeve 308 is positioned in the lower position with the collet fingers 312 on its lower end gripping the lower collet finger grip profile 314. When it is desired to seal the float shoe 214 from the remainder of the center bore 208 above the sliding sleeve valve 300, the sliding sleeve 308 is positioned in the upper position with the collet fingers 312 on its upper end gripping the upper collet finger grip profile 314. The sliding sleeve 308 can be shifted between these positions with a shifting tool gripping the profile 316 on the interior of the sliding sleeve 308. In certain instances, the sliding sleeve valve is a MCS Closing Sleeve valve, a trademark of Halliburton Energy Services, Inc. Other examples exist and are within the concepts herein.

Figure 4:
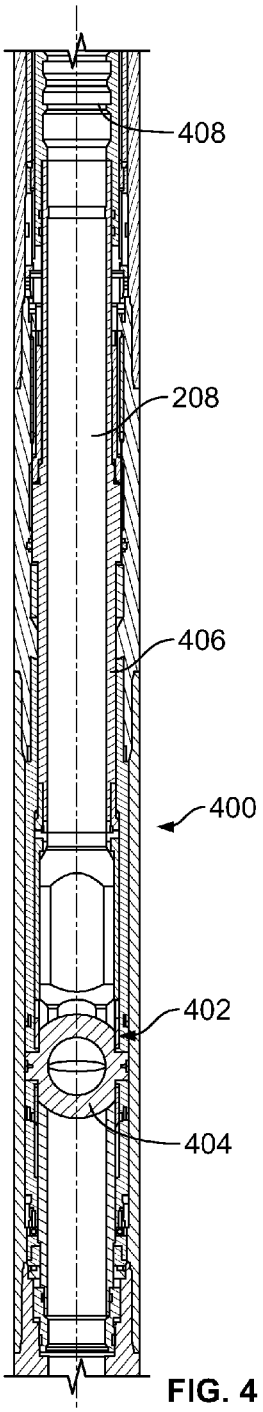
FIG. 4 is a half cross-sectional detail view of an example reservoir isolation valve in a completion string.

Referring back to FIG. 2, as discussed above, a reservoir isolation valve 206 is provided in the lower completion string 200 downhole from the packer, and uphole from where the subterranean zone is communicated with the center bore 208 of the lower completion (i.e. uphole from the sand screens). The reservoir isolation valve 206 can take many forms. FIG. 4 shows an example reservoir isolation valve 400 that can be used. The reservoir isolation valve 400 has a ball valve 402 positioned in the center bore 208, changeable between sealing against passage of fluids through the center bore 208, and allowing passage of fluid through the central bore 208. The ball valve 402 has a spherical ball closure 404 that is moved together with an actuating sleeve 406, such that as the actuating sleeve 406 is moved uphole, the ball closure 404 is closed and, as the actuating sleeve 406 is moved downhole, the ball closure 404 is opened. The actuating sleeve 406 has a profile 408 on its interior diameter to be gripped by a shifting tool (discussed in more detail below). In certain instances, the reservoir isolation valve 400 has provisions for hydraulic actuation, as well, allowing the valve 400 to be opened in response to a specified hydraulic signal through the center bore 208 of the lower completion string 200. In certain instances, the reservoir isolation valve is an FS Valve, a trademark of Halliburton Energy Services, Inc. Other examples exist and are within the concepts herein.

The valve 216 (FIG. 2) to isolate the float shoe 214 and the reservoir isolation valve 206 can be actuated by a single working string run from the wellhead at the surface into the center bore 208 of the lower completion string 200. FIGS. 5-7 show a downhole end portion of an example working string 500. Each view shows the same portion of the working string 500 in different modes of operation. The working string 500 uphole from the views in FIGS. 5-7 can include additional tubing and tools extending to the surface. In certain instances, the working string 500 can be the wash pipe used in supplying fluids for a wash over operation in completing the well system.

As seen in FIGS. 5A-D the working string 500 includes an outer tubular string 502 that terminates at its downhole end in a mule shoe 504. A shifting profile 506 for a reservoir isolation valve (e.g., valve 206, FIG. 2) is provided near the downhole end (near the mule shoe 504) of the outer tubular string 502, and is provided on a collet support 532 that allows the profile 506 to move radially. The shifting profile 506 is adapted to engage the internal profile of an actuating sleeve (e.g., internal profile 408 of actuating sleeve 406, FIG. 4) when the outer tubular string 502 is passed through the reservoir isolation valve 206, and shift the actuating sleeve in the direction that the outer tubular string 502 is passed. For example, typically (though not necessarily), the working string 500 will be run-in to the wellbore together with the completion string 200 with the profile of the outer tubular string 502 in or below the reservoir isolation valve 206. As the outer tubular string 502 is withdrawn uphole through the reservoir isolation valve 206, the shifting profile 506 engages the internal profile of the actuating sleeve and draws the actuating sleeve uphole, closing the reservoir isolation valve 206. The outer tubular string 502 can be moved downhole through the reservoir isolation valve 206, and it is shifting profile 506 will engage the internal profile of the actuating sleeve. The outer tubular string 502 will push the actuating sleeve downhole, opening the reservoir isolation valve 206. The outer tubular string 502 can be moved uphole and downhole through the reservoir isolation valve 206 operating the reservoir isolation valve 206 open and close as many times as is needed.

Figure 5A:
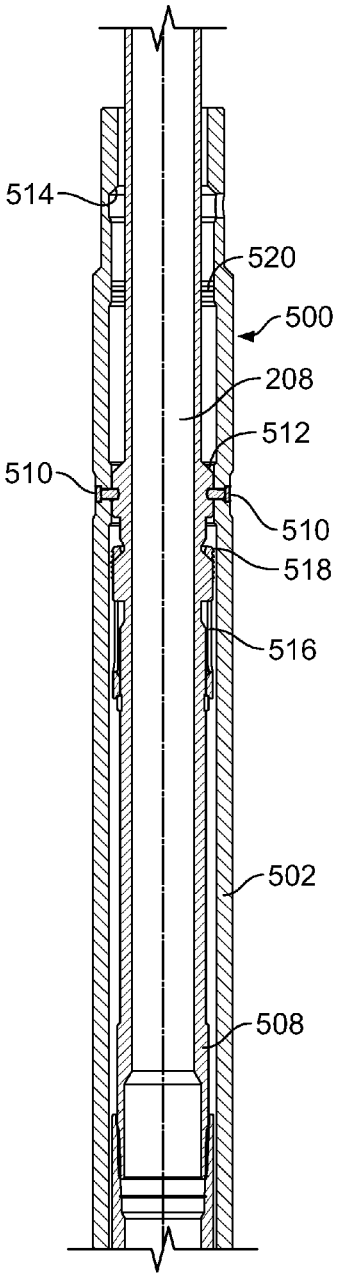
FIGS. 5A-D are a half cross-sectional detail view of a portion of a working string, with an inner tubular string pinned to an outer tubular string.
Figure 6A:
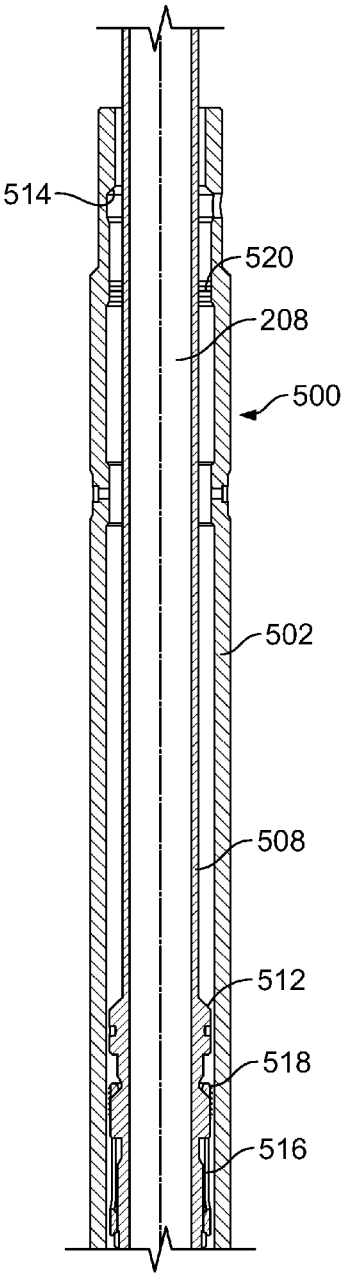
FIGS. 6A-D are half cross-sectional detail view of the portion of the working string of FIG. 5A-D with the inner tubular string released from the outer tubular string and extended out of the downhole end of the outer tubular string.

The outer tubular string 502 internally receives an inner tubular string 508 in its center bore 208 so that the inner tubular string 508 can move axially with respect to the outer tubular string 502. The inner tubular string 508 is sealingly coupled to the remainder of the working string 500 that extends to the surface, and shares a common central bore 208 with the remainder of the working string 500. As shown in FIG. 5A, the inner tubular string 508 is initially pinned to the outer tubular string 502 with one or more shear pins 510 (a plurality shown) or other frangible connection when the working string 500 is run into the wellbore. The shear pins 510 fix the outer tubular string 502 and the inner tubular string 508 so that they do not move relative to one another. As shown in FIG. 6A, applying downward force to the inner tubular string 508 with the outer tubular string 502 landed on a shoulder 218 lower completion string 200 can break the shear pins 510, releasing the outer tubular string 502 and inner tubular string 508 to move relative to one another.

Figure 7A:
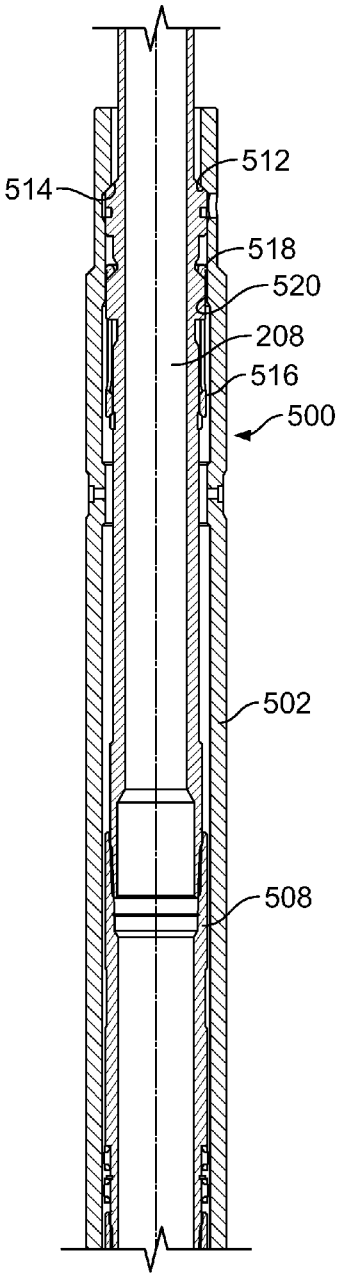
FIGS. 7A-D are half cross-sectional detail view of the portion of the working string of FIGS. 5A-D with the inner tubular string retracted back into the outer tubular string in affixed to the outer tubular string.
Figure 6B:
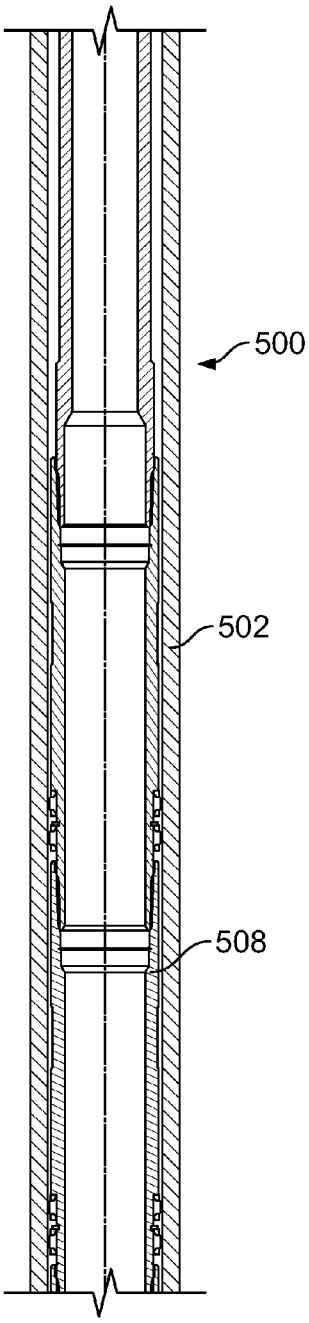
Figure 7B:
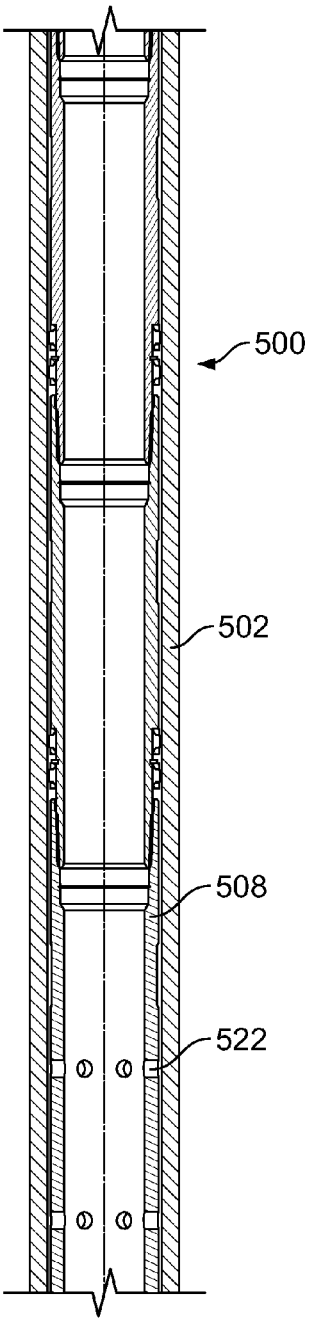

As shown in FIG. 7A, the inner tubular string 508 has an upward facing shoulder 512 that abuts a downward facing shoulder 514 on the interior of the outer tubular string 502 as the inner tubular string 508 is withdrawn uphole through the outer tubular string 502. When the shoulders 512, 514 abut, the inner tubular string 508 lifts the outer tubular string 502 uphole, enabling the inner tubular string 508 and the outer tubular string 502 to be withdrawn uphole together. Additionally, as shown in FIG. 7A, the inner tubular string 508 has a latch. In certain instances, the latch is one or more radially outwardly biased collet fingers 516 (a plurality shown) near its uphole end, and below the upwardly facing shoulder 512. The outer surface of the collet fingers 516 has a thread profile 518 that engages and grips a corresponding thread profile 520 on the outer tubular string 502 when the shoulders 512, 514 abut. When mated, the thread profiles 518, 520 fix the inner tubular string 508 and outer tubular string 502 together, particularly when moving downhole. The thread profiles 518, 520 are biased so that as the inner tubular string 508 is drawn uphole in the outer tubular string 502, the collet fingers 516 flex inward, and the thread profile 518 of the collet fingers 516 ratchets over the thread profile of the outer tubular string 502. The inner tubular string 508 can later be released from the outer tubular string 502 by rotating the inner tubular string 508 to unthread the mating thread profiles 518, 520. Notably, as shown in FIG. 5A, the thread profile 516 of the collet fingers 516 is below and out of engagement with the corresponding thread profile 520 in the outer tubular string 502 when the inner tubular string 508 is initially pinned by the shear pins 510.

Figure 5B:
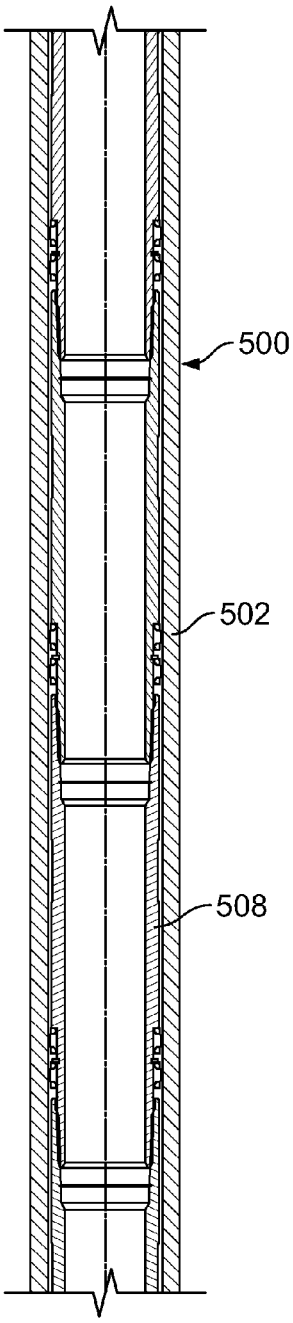
Figure 5C:
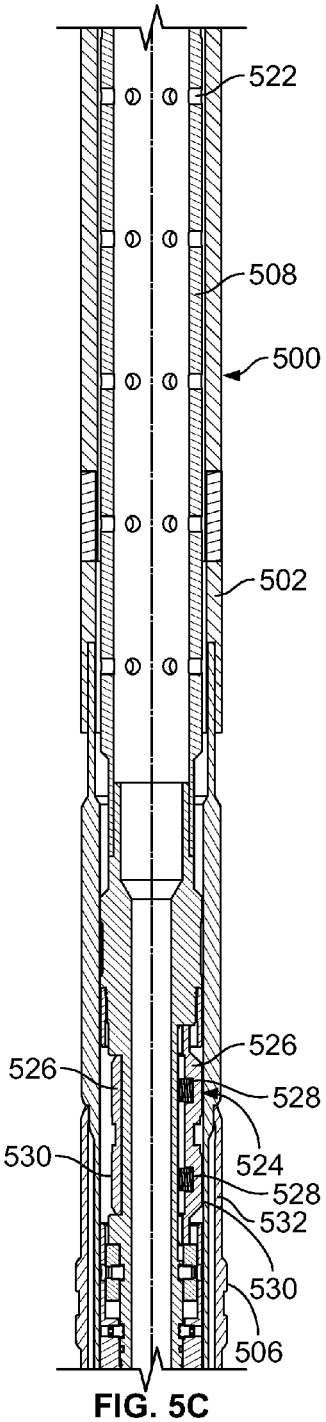
Figure 6C:
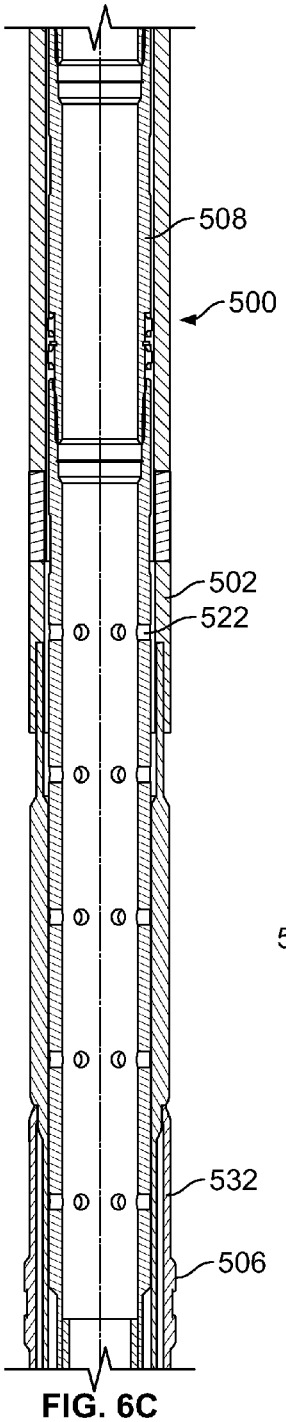
Figure 7C:
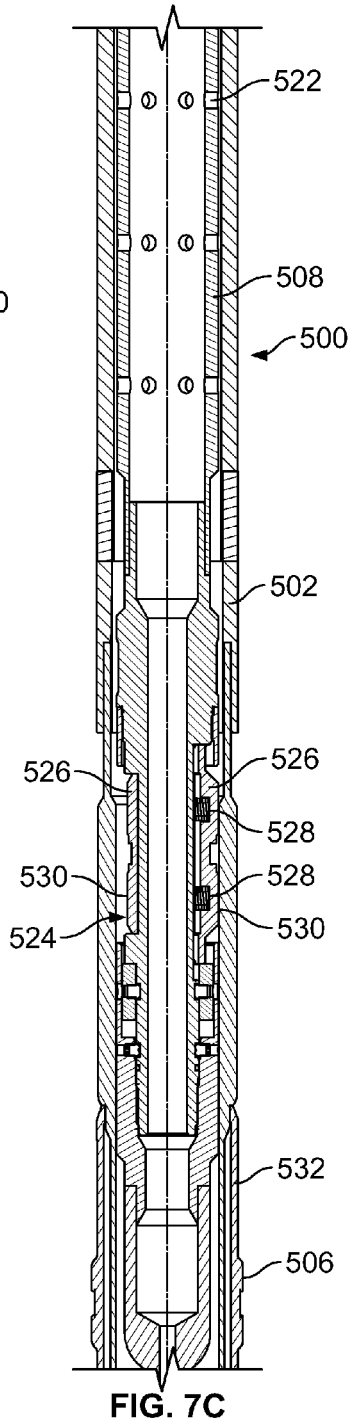
Figure 5D:
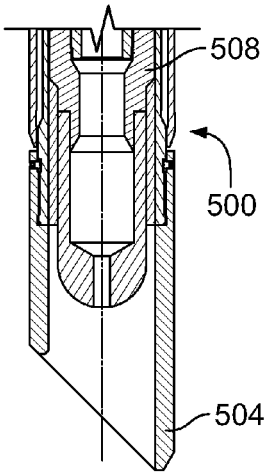
Figure 6D:
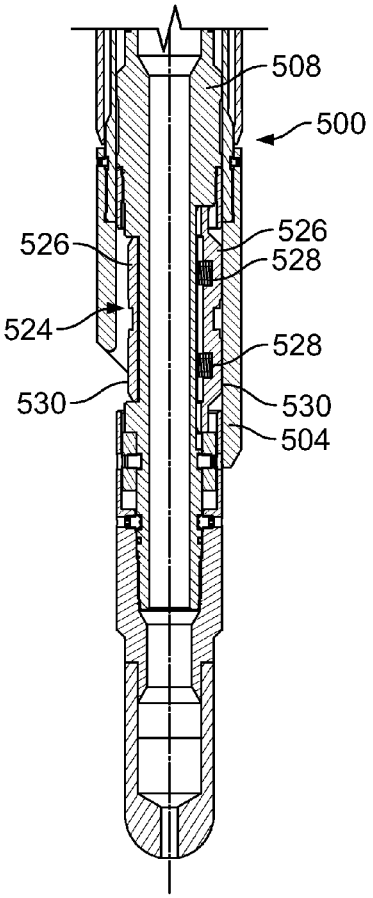
Figure 7D:
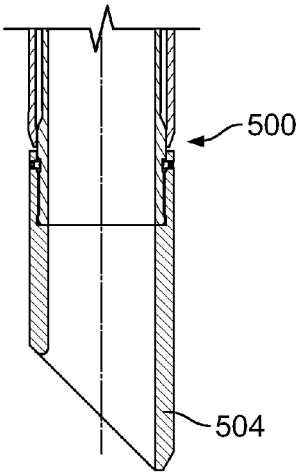

As shown in FIGS. 5C, 6C, and 7C, an intermediate portion of the inner tubular string 508 is apertured (apertures 522) to allow passage of fluids between the exterior of the inner tubular string 508 and its center bore 208. These apertures 522 can be aligned with the valve 216 by moving the inner tubular string 508 apart from the outer tubular string 502, for use in supplying fluids through the valve 216 and out of the float shoe 214.

As shown in FIGS. 5C, 5D, 6D and 7C, the downhole end of the inner tubular string 508 has a shifting tool 524 for engaging the valve 216 to isolate the float shoe 214. The shifting tool 524 has one or more keys 526 (a plurality shown) biased radially outward by springs 528. Each profile block 526 has a profile 530 adapted to engage and grip the internal profile of the shifting sleeve of the valve 216 (e.g., profile 316 of sliding sleeve 308, FIG. 3A). When the inner tubular string 508 is pinned to the outer tubular string 502, the keys 526 are received in the outer tubular string 502, retracted with the springs 528 compressed. In this position, the keys 526 cannot interfere with or hang on any diametrical changes in the interior of the lower completion string 200. When the inner tubular string 508 is released from and moved out of the outer tubular string 502, the keys 526 are released to spring radially outward. Thereafter the keys 526 can engage and manipulate the shifting sleeve of valve 216 to open or close the valve 216.

In operation, with reference to FIGS. 2 and 5-7, the working string 500 is inserted into the lower completion string 200 with the inner tubular string 508 pinned to the outer tubular string 502 (FIGS. 5A-D), and positioned past the reservoir isolation valve 216 with the outer tubular string 502 on the shoulder 218 of the lower completion string 200. The keys 526 are retained within the outer tubular string 502. The lower completion string 200 and working string 500 are lowered into position in the wellbore together. The inner tubular string 508 is then released from the outer tubular string 502 (the shear pins 510 are sheared), and the inner tubular string 508 moves downhole out of the downhole end of the outer tubular string 502 (FIG. 6A-D). The inner tubular string 508 can then be moved to align its apertures 522 with the valve 216 to supply fluids out the float shoe 214, for example for a washdown or other injection operation. In moving the inner tubular string 508 downhole, the keys 526 engage the sliding sleeve of the valve 216 and, if it is not already in its downhole position, drive the sliding sleeve downhole to open the ports.

When desired, the working string 500 is partially withdrawn uphole, lifting the inner tubular string 508 into the outer tubular string 502. The keys 526 draw the sliding sleeve of valve 216 closed, isolating the float shoe 214 from the remainder of the center bore 208 above the valve 216. Thereafter, any leakage through the float shoe 214 will not be communicated uphole through the center bore 208. Also, upon lifting the inner tubular string 508 into the outer tubular string 502, the upward facing shoulder 512 of the inner tubular string 508 abuts the downward facing shoulder 514 of the outer tubular string 502 so that the outer tubular string 502 lifts together with the inner tubular string 508. Additionally, the thread profile 518 on the outwardly biased collet fingers 516 engages and grips the corresponding thread profile 520 of the outer tubular string 502 further fixing the inner tubular string 508 and outer tubular string together 502. Further withdrawal engages the shifting profile 506 on the exterior of the outer tubular string 502 with the actuating sleeve of the reservoir isolation valve 206 and closes the reservoir isolation valve 206. Thereafter, the working string 500 an be withdrawn from the well and/or maintained in the well. With the reservoir isolation valve 206 closed, a pressure test can be performed on the completion string above the reservoir isolation valve 206 and formation fluids are sealed against flowing up through the center bore 208. In certain instances, the reservoir isolation valve 206 can be re-opened in response to a hydraulic signal.

If it is desired to reopen the reservoir isolation valve 206, the working string 500 can be moved back downhole. Because the outer tubular string 502 is locked to the inner tubular string 508 by the engaged thread profiles 518, 520, the outer tubular string 502 moves with the inner tubular string 508 and the remainder of the working string 500 as a single unit. The outer tubular string 502 is moved downhole to engage and shift the actuating sleeve of the reservoir isolation valve 206 and open the reservoir isolation valve 206. As noted above, the reservoir isolation valve 206 can be opened and closed as many times as is desired by moving the working string 500 uphole and downhole.

When desired, the working string 500 can be withdrawn to the surface and out of the wellbore carrying both the inner tubular string 508 and the outer tubular string 502 as a single unit.

It follows from the above that the concepts herein encompass a method where, using a working string, a first valve of a completion string in a well is actuated to seal the float shoe of the completion string from the remainder of the completion string. The working string is also used to actuate a second valve of the completion string to seal a center bore of the completion string. Actuating the first valve and the second valve is performed without withdrawing the working string from the well.

The concepts also encompass a well completion string having a float shoe at a downhole end in communication with the central bore of the completion string. The well completion string has a first valve closable to seal the float shoe from a portion of the central bore of the completion string. The completion string also has a second valve closable to seal the central bore apart from the first valve. The system includes a working string that has a shifting profile for closing the first valve and shifting profile for closing the second valve.

The concepts also encompass a method where a first valve is closed to isolate a float shoe of completion string and a second valve is closed to seal a center bore of the completion string, both in a single trip.

The concepts herein can encompass some, none or all of the following features. In certain instances, the working string is a wash pipe. In certain instances, the valve to seal a center bore the completion string is a reservoir isolation valve. Actuating the first valve of the completion string includes closing the first valve with a first shifting profile of the working string, and actuating the second valve includes actuating second valve with a second, different shifting profile of the working string. The working string includes an inner tubular that has the first shifting profile and an outer tubular that has the second shifting profile. Closing the first valve includes moving the inner string relative to the outer string. In certain instances, the inner string can be moved wholly within the outer string and the inner string fixed to the outer string so that the inner string and outer string move together as a single unit. The inner string and the outer string of the working string can be carried into the well concurrently. They can also be carried out of the well concurrently. In certain instances the inner string is initially fixed to the outer string with a frangible connection.

A number of embodiments have been described. Nevertheless, it will be understood that various modifications may be made. Accordingly, other embodiments are within the scope of the following claims.

What is claimed is:

1. A method, comprising:

using a radially biased shifting key profile located on an outer surface of an inner string of a working string that is received within an outer string of the working string, the working string being received within a completion string located within a wellbore, to contact an interior first valve profile of a first valve of the completion string to move the first valve to a closed position, the completion string having one or more sand screens located uphole of the first valve, and when in the closed position, the first valve isolating the one or more sand screens from a fluid flow in a center bore of a portion of the completion string emanating from a float shoe located downhole of the first interior valve; and subsequent to using the radially biased shifting key profile, locking the inner string to the outer string to cause the radially biased shifting key profile and a second shifting profile located on the surface of the outer string to move together as a single unit;

using the second shifting profile of the outer string, when locked with the inner string to contact an interior second valve profile of a second valve the completion string located above the one or more sand screens to move the second valve to a closed position to seal the center bore of the completion string, the closing of the first valve and the second valve performed without withdrawing the working string from the well, and wherein the first valve and second valve remain in the closed position subsequent to withdrawing the working string from the well.

2. The method of claim 1, wherein using the radially biased shifting key profile includes releasing spring biased keys to spring radially outward from the inner string to engage the interior first valve profile.

3. The method of claim 2, wherein releasing the spring biased keys includes releasing the inner string from the outer string.

4. The method of claim 1, wherein using the interior second valve profile includes using the interior second valve profile to open and close the second valve a plurality of times prior to withdrawing the completion string from the well.

5. The method of claim 1, wherein the float shoe is adjacent a downhole end of the completion string.

6. The method of claim 1, wherein the float shoe has one or more internal check valves biased to allow for from the center bore.

7. The method of claim 1, further including fixing the inner string to the outer string by engaging a thread profile of the inner string with a corresponding thread profile of the outer string.

8. The method of claim 1, wherein using the radially biased shifting key profile to shift the first valve to a closed position prevents a leakage of the float shoe from being communicated into fluids being produced up the center bore.

9. A system, comprising:

a well completion string comprising:

one or more sand screens positioned along a length of the well completion string;

a working string, including:

an inner string having a radially biased shifting key profile on an outer surface of the inner string;

an outer string having a second valve shifting profile on an outer perimeter of the outer string, wherein the inner string is received within the outer string and the inner and outer strings being couplable to move together as a single unit;

a float shoe located below the one or more sand screens and at a downhole end in fluid communication with a central bore of the completion string;

a first valve located between the one or more sand screens and the float shoe and having an interior first profile that is engageable with the radially biased shifting key profile to move the first valve to a closed position and seal the float shoe from a fluid flow in the central bore of the completion string located above the first valve; and a second valve located above the one or more sand screens and having an interior second valve profile that is engageable with the second valve shifting profile to seal the central bore apart from the first valve to isolate the one or more sand screens across a reservoir.

10. The system of claim 9, wherein the radially biased shifting key profile includes spring biased keys configured to spring radially outward from the inner string to engage the radially biased shifting key profile.

11. The system of claim 9, comprising a latch to selectively fix the inner string and outer string to move together as a single unit.

12. The system of claim 11, where the latch is engageable to fix the inner string to the outer string without removing the working string from the well.

13. The system of claim 9, comprising a shear pin fixing the inner string and outer string to move together as a single unit.

* * * * *